United States Patent [19]

Rogers, Jr.

[11] Patent Number: 4,570,995

[45] Date of Patent: Feb. 18, 1986

[54] TWO-WAY ACTUATOR FOR RECLINING CHAIR

[75] Inventor: Walter C. Rogers, Jr., Denton, N.C.

[73] Assignee: Parma Corporation, Denton, N.C.

[21] Appl. No.: 679,026

[22] Filed: Dec. 6, 1984

[51] Int. Cl.[4] ..... A47C 1/02

[52] U.S. Cl. ..... 297/68; 297/85; 297/75

[58] Field of Search ..... 297/84, 68, 75, 85, 297/77; 74/96, 491, 89, 104

[56] References Cited

U.S. PATENT DOCUMENTS

| | | | |
|---|---|---|---|
| 4,071,275 | 1/1978 | Rogers, Jr. | 297/85 |
| 4,291,913 | 9/1981 | Kowalski | 297/68 |
| 4,332,417 | 6/1982 | Mizelle | 297/68 |
| 4,337,977 | 7/1982 | Rogers, Jr. et al. | 297/322 |
| 4,350,386 | 9/1982 | Rogers, Jr. | 297/322 |
| 4,350,387 | 9/1982 | Rogers, Jr. | 297/322 |

*Primary Examiner*—Francis K. Zugel

*Attorney, Agent, or Firm*—William E. Mouazvires

[57] ABSTRACT

A two-way actuator is provided for a reclining chair preferably of the type that is driven to the reclining positions by the weight of the chair occupant. In such chairs, the reclining mechanisms are typically linkage systems that are held in retracted position by a lock mechanism. A release is provided to actuate the lock mechanism to permit the weight of the chair occupant to drive the reclining mechanism to TV position wherein the footrest is extended. The two-way actuator of the present invention is connected to the release so that the chair occupant may rotate a handle in the form of a knob, for example, in either clockwise or counter-clockwise direction to actuate the release to open the lock mechanism and thereby permit movement of the chair to the TV position.

7 Claims, 5 Drawing Figures

TWO-WAY ACTUATOR FOR RECLINING CHAIR

BACKGROUND OF INVENTION

Recliner chairs in use today are actuated by various methods to place the chair into the TV position in which the footrest is projected from the front of the chair. In one typical method, a handle resembling a lever at one side of the chair is grasped by the chair occupant and rotated in one direction. The handle is connected to a drive shaft which serves to drive a mechanism for projecting the footrest such as, for example, shown in my prior U.S. Pat. Nos. 3,767,257, 4,071,275, 4,108,491, 4,226,469 and 4,188,062. In other chairs such as, for example, shown in my prior U.S. Pat. No. 4,350,387 wherein the footrest is projected by the weight of the chair occupant, the drive shaft is connected to a release which opens a lock mechanism to allow the footrest to move into the extended position solely through the force of gravity derived through the weight of the chair occupant. The reclining mechanism of the latter type of chair is sometimes referred to as a "gravity mechanism".

In other chairs such as those disclosed in Re' U.S. Pat. Nos. 3,958,827 and 3,941,417, actuation is achieved by the chair occupant applying pressure to the backrest which, through linkages, transfers forces to the footrest for extending the footrest into the TV position. Another actuating system utilizes the armrests of the chairs such as, for example, disclosed in my U.S. Pat. Nos. 4,185,869 and 4,249,772 for driving the footrest to the TV position.

Additionally, there are recliner chairs containing gravity mechanisms which are actuated by moving the seat through holding the armrests such as, for example, shown in my prior U.S. Pat. No. 4,418,957. Another chair actuated in the foregoing manner is disclosed in my prior U.S. Pat. No. 4,357,049.

Another type of actuator is disclosed in my pending U.S. patent application Ser. No. 06/419,156, filed Sept. 17, 1982, entitled "Trigger Release Mechanism For Reclining Chair", wherein a small trigger in the form of a lever is mounted to one side of the chair at a conveniently elevated position to allow the chair occupant to actuate the chair through a flick of the trigger.

With all of the actuators described above, the prime actuator, whether it be a handle, trigger, backrest, armrests or seat, etc., it is necessary that the prime actuator or actuator movement be moved or occur in but one direction. At times, the latter requirement can confuse the chair occupant when he or she, for example, attempts to move the actuator handle in the wrong direction.

OBJECTS OF THE PRESENT INVENTION

It is a principle object of the present invention to provide a novel actuator system for a reclining chair that allows the chair occupant to move a prime mover such as a handle in either of two directions in order to actuate the chair into the TV position. Included herein is such a novel actuator system that allows a small, unobtrusive handle such as a knob, for example, to be utilized as a prime mover which may be rotated in clockwise or counterclockwise direction in order to actuate the chair to TV position.

Another object of the present invention is to provide a novel linkage mechanism for interconnecting the prime mover and the reclining mechanism of a recliner chair to permit the above objects to be achieved.

A further object of the present invention is to provide such a novel actuator system that may be applied to conventional recliner mechanisms of the type in use today without requiring any major design, reconstruction or revision of the basic linkage mechanisms of the chairs.

SUMMARY OF THE PRESENT INVENTION

The present invention may be summarized with reference to a recliner chair having a drive shaft that is rotatable to initiate actuation of the reclining mechanism to TV position. In the preferred embodiment, a small handle is mounted to one side of the chair to be rotatable or pivotable in clockwise or counterclockwise direction; a novel means or "transmission linkage" is provided interconnecting the handle and the drive shaft such that the drive shaft will be rotated to actuate the chair to TV position upon rotation of the handle in either clockwise or counterclockwise direction.

In the preferred embodiment of the invention, the transmission linkage includes a pair of transmission links whose lower ends converge at a pivot pin received in elongated slots formed in the lower ends of said transmission links. The pivot pin is fixed to an arm that is connected to the drive shaft to rotate the same through a driving force transmitted through either of the transmission links. The upper ends of the transmission links are pivoted to opposite end portions of a rocker arm whose center is pivotally mounted to be rotatable in either clockwise or counterclockwise direction for depressing one transmission link while raising the other link or vice versa. The transmission link that is raised becomes active to rotate the drive shaft through engagement of the pivot pin in the end of the slot in the active transmission link. The transmission link that is depressed becomes idle while its slot accommodates the rising pivot pin driven by the active transmission link.

In one preferred embodiment, a small knob is fixed to a mounting shaft that is connected to the rocker arm to rotate the same in clockwise or counterclockwise direction upon rotation of the knob in either of said directions.

DRAWINGS

Other objects and advantages of the present invention will become apparent from the following more detailed description of the drawings in which.

DETAILED DESCRIPTION

Figure 5:
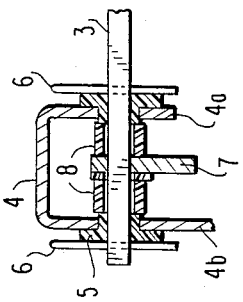
FIG. 5 is a fragmental cross-sectional view of an upper portion of the parts shown in FIG. 2.

Referring now to the drawings in detail, there is shown for illustrative purposes only, a reclining chair incorporating a preferred embodiment of the two-way actuator of the present invention. Although the invention may be incorporated in various reclining chairs as will be explained below, the illustrated chair corresponds to that disclosed in my prior U.S. Pat. No. 4,350,387 and entitled "Reclining Chair With Improved Actuation", issued Sept. 21, 1982, whose disclosure is hereby incorporated in its entirety by reference into the present application as a part hereof.

The illustrated chair is of the type employing what is sometimes referred to as a "gravity mechanism" which causes the chair to be moved to TV position, that is where the footrest is extended, solely through the weight of the occupant of the chair. To initiate such action, a release mechanism must be actuated through means of a drive element 95 to open a lock mechanism which normally holds the chair linkage in the closed position when the chair is in the normal or generally upright position with the footrest closed (or retracted). The lock mechanism in the specific chair disclosed includes a pair of knuckle links, one of which is link 92 fixed to drive element 95 to be driven thereby.

Figure 1:
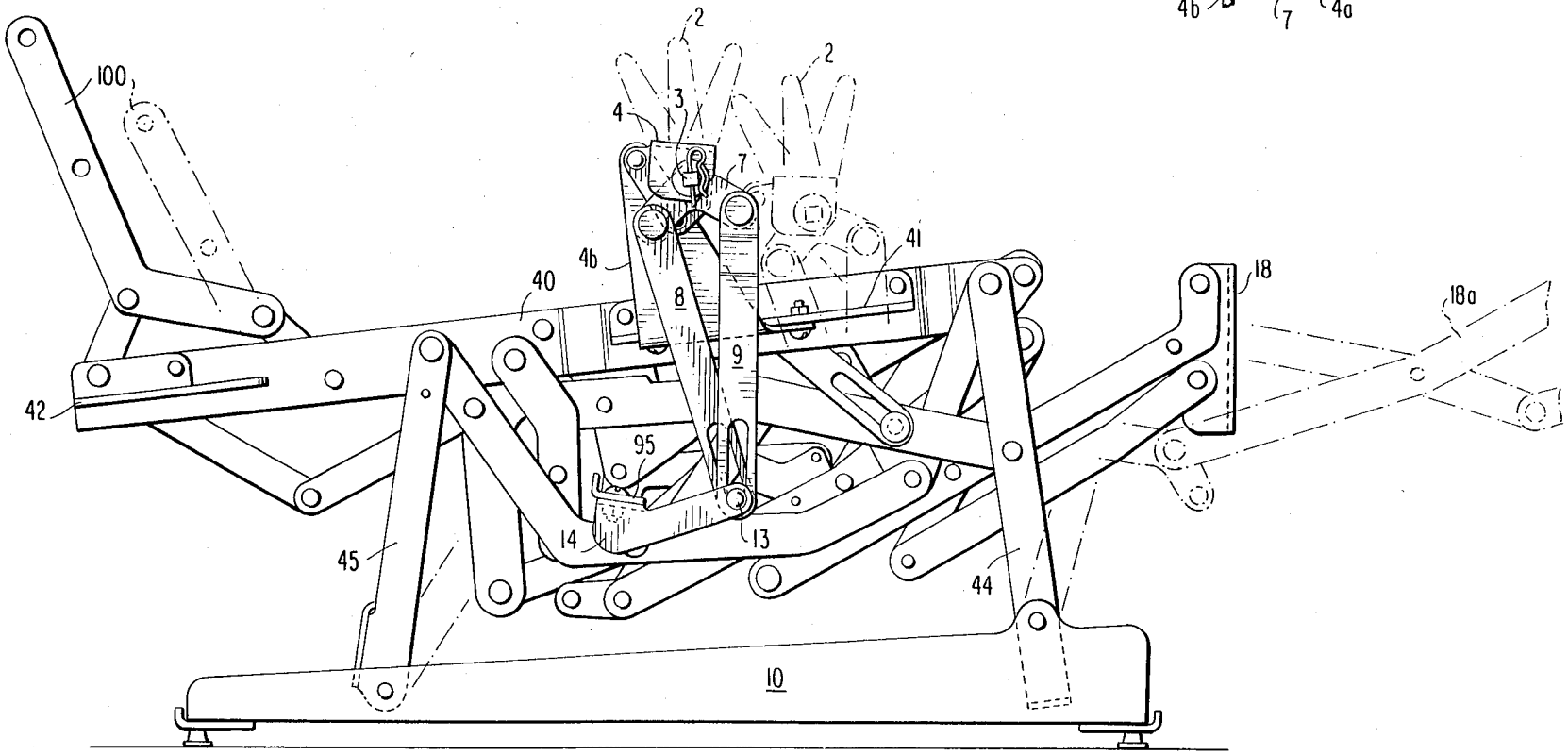
FIG. 1 is a side elevational view of a recliner chair incorporating the present invention and showing the linkage systems of the chair with the upholstery removed for clarity and with phantom lines showing a reclining position.

Referring to FIG. 1, basic parts of the disclosed chair include a base 10, a seat link 40 including lateral flanges 41 and 42 for mounting the seat and armrest unit (not shown) to the seat link; and a seat linkage including front and rear primary links 44 and 45 for mounting the seat link 41 to the base 10 for movement between various reclining positions including TV position wherein the footrest 18 is projected forwardly from the chair as indicated by the phantom lines 18*a* in FIG. 1. Additionally, included is a backrest linkage including a backrest link 100 pivotally mounted to the seat link 41 and also connected to the seat linkage to drive the backrest and seat linkage into advanced reclining positions beyond TV position.

A more detailed description of the chair including the parts described above which form no part of the present invention may be gained from my U.S. Pat. No. 4,350,387 identified above.

Figure 3:
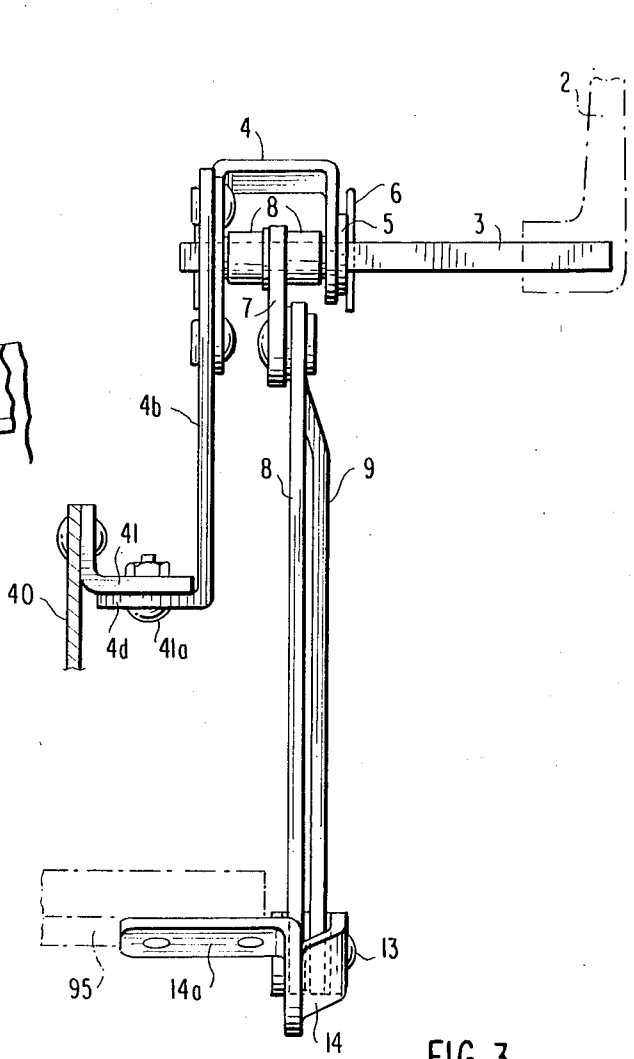
FIG. 3 is an end view of the two-way system as seen along lines 3—3 of FIG. 2.

In accordance with the present invention, a novel two-way actuator is incorporated in the chair to actuate the drive element 95 in place of the one-way handle designated 97 in my U.S. Pat. No. 4,350,387 which handle 97 is fixed to drive element 95 in the chair disclosed in said patent. In the actuation system of the present invention, the handle or prime mover may be any suitable element such as a knob or lever, the latter being shown at 2 in the drawings to facilitate illustration of the invention. Handle 2 is fixed to a shaft 3 as shown in FIG. 3. Shaft 3 in the shown emboidiment has a rectangular or square cross section and is mounted for rotation in a bracket generally designated 4 including opposite legs 4*a* and 4*b*. In the specific embodiment shown, a pair of low friction flanged bearing sleeves 5 are received on the shaft 3 for rotation therewith in aligned apertures formed in legs 4*a* and 4*b* as shown in FIG. 5. Bearing sleeves 5 are held in place by abutment of their flanges against bracket legs 4*a* and 4*b*, and pins 6 received through apertures in shaft 3 behind sleeves 5.

Bracket 4 is fixed to the seat link 40 through one of its legs 4*b* which extends vertically below flange 41 of the seat link 40 and has a flange 4*d* fixed to flange 41 by means of fasteners shown in FIG. 3 as a nut and bolt assembly 41*a*. Shaft 3 is thus mounted in bracket 4 for rotation in either the clockwise or counterclockwise direction by manipulation of handle 2.

Figure 2:
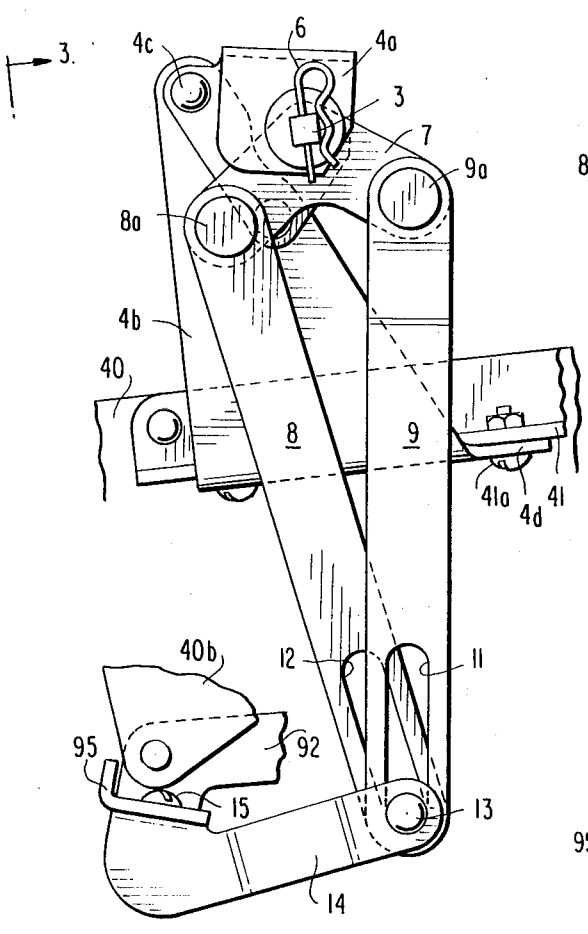
FIG. 2 is an enlarged side elevational view of a two-way actuating system embodying the present invention as incorporated in the of chair FIG. 1.

In the specific embodiment shown, the actuation system further includes a rocker arm or crank 7 mounted at its midpoint about shaft 3 to be rotatable with shaft 3. This mounting is achieved through a rectangular aperture formed in the rocker arm to receive the shaft 3. Rocker arm 7 is held in proper position on shaft 3 by means of a pair of spacer sleeves 8 fixed on shaft 3 in opposite sides of rocker arm 7. Referring to FIG. 2, the opposite ends of rocker arm 7 are pivotally connected by pivots 8*a* and 9*a* to the upper ends of a pair of transmission links 8 and 9 respectively. Transmission links 8 and 9 extend downwardly generally vertically from rocker arm 7 to the level of drive element 95. The lower ends of transmission links have elongated slots 11 and 12 respectively formed therein to extend in the longitudinal direction of the transmission links. Within both slots 11 and 12 is mounted a pivot pin 13 which is fixed to one end of a crank arm 14. The opposite end of crank arm 14 has a laterally extending flange 14*a* which is bolted at 15 to the underside of drive element 95 as shown in FIGS. 2 and 3.

Figure 4:
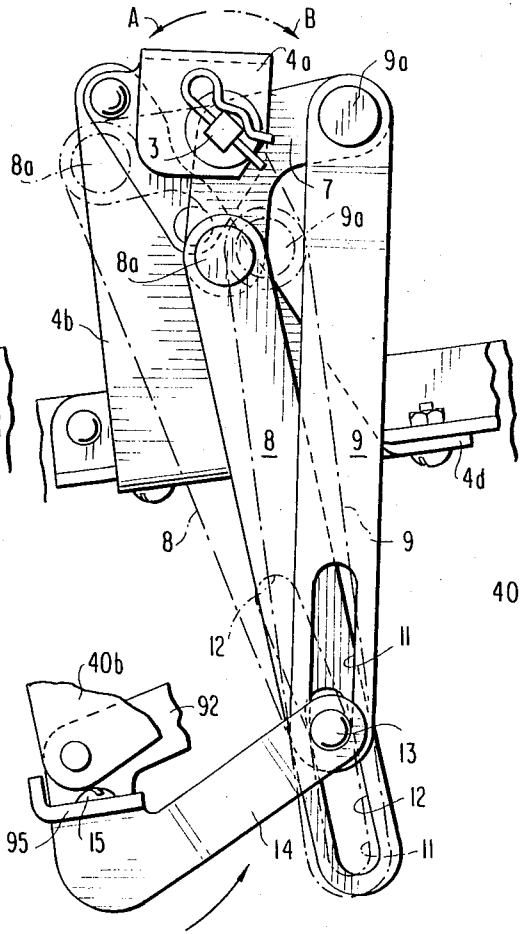
FIG. 4 is a view similar to FIG. 2 but with the parts shown in different positions when the chair is actuated to TV position.

When the chair is in the normal generally upright position, the actuation system is in the position shown in FIGS. 1 and 2 with the pivot 13 positioned in the bottom of both slots 11 and 12 of transmission links 8 and 9. Referring now to FIG. 4, if the handle 2 is moved in the direction of the arrow A, the rocker arm 7 will rotate counterclockwise raising transmission link 9 and lowering transmission link 8. Transmission link 9 will thus become active to pivot crank arm 14 upwardly by virtue of engagement of the pivot 13 in the bottom of slot 11. Crank arm 14 will thus actuate drive element 95 to initiate movement of the seat linkage to place the chair into the TV position with the footrest 18 projected from the front of the chair. While transmission link 9 is active to pivot crank arm 14 as described above, the other transmission link 8 will be idle as pivot 13 rides up the slot 12 in transmission link 8. When the chair is returned from TV to the upright position by the chair occupant engaging and retracting the footrest 18 with the legs, crank arm 14 and transmission links 8 and 9 will be returned to their original positions shown in FIG. 2.

Instead of rotating the handle 2 in the direction of the arrow A shown in FIG. 4, if the chair occupant rotates the handle 2 in the direction of arrow B, the rocker arm 7 will rotate in the clockwise direction into the phantom line position shown in FIG. 4. This will raise transmission link 8 which will thus become active to pivot crank arm 14 upwardly by virtue of engagement of pivot 13 in bottom of slot 12 of transmission link 8. The other transmission link 9 will be idle as the pivot 13 rides up its slot 11. The positions of transmission links 8 and 9 in this mode are shown in phantom lines in FIG. 4.

It will thus be seen that regardless of the direction in which handle 2 is rotated, it will be effective to place the chair into TV position. It will also be seen that the actuation system of the present invention may be applied not only to the type of recliner chair shown in the drawings and described herein, but it may also be applied to other types of recliner chairs which need not be of the "gravity mechanism" type. For example, such chairs are disclosed in my prior patents which have been identified above.

What is claimed is:

1. In a recliner chair having a footrest movable between extended and retracted positions, and means including a drive element for moving the footrest to the extended position; an actuator system including a prime mover movable in either of two opposite directions, and linkage means interconnecting the prime mover and the drive element to actuate the drive element to cause extension of the footrest upon movement of said prime mover in either of said opposite directions.

2. The recliner chair defined in claim 1 wherein said linkage means includes a pair of transmission links having a lost motion connection with respect to the drive element and means connecting the transmission links to said prime mover.

3. The recliner chair defined in claim 2 wherein said means connecting the transmission links to said prime mover includes a rocker arm pivotable about an intermediate portion thereof and having opposite end portions pivotally connected to said transmission links, and wherein said prime mover is connected to said rocker arm to pivot the same in either clockwise or counterclockwise direction.

4. The recliner chair defined in claim 3 wherein said lost motion connection includes slots formed in lower ends of said transmission links and receiving a pivot pin, said rocker arm being pivotally connected to upper end portions of said transmission links to depress one transmission link while raising the other transmission link upon rotation of the rocker arm, said pivot pin being connected to said drive element to actuate the same upon engagement of the pivot pin in the end of the slot in one transmission link upon upward movement of said one transmission link.

5. The recliner chair defined in claim 4 wherein said linkage means includes a crank arm having one end portion fixed to said pivot pin and an opposite end position fixed to said drive element to actuate the same.

6. The recliner chair defined in claim 5 including a shaft mounted for rotation on one side of the chair, said rocker arm being fixed to said shaft to be rotatable therewith, and wherein said prime mover is connected to said shaft to rotate the shaft in either clockwise or counterclockwise direction.

7. A two-way actuator for a recliner chair including a bracket adapted to be fixed to a seat portion of the chair, a shaft mounted for rotation in the bracket in clockwise or counterclockwise directions, a rocker arm fixed at an intermediate location thereof to the shaft to be rotatable therewith, a pair of transmission links pivotally connected to opposite ends of said rocker arm, said transmission links having elongated slots therein spaced from their connection to said rocker arm, a crank arm having a pivot received in both slots of said transmission link to be actuated by one of said transmission links depending upon the direction of rotation of said shaft, said crank arm adapted to be connected to a drive element of a recliner chair to actuate the chair upon rotation of said shaft in either clockwise or counterclockwise direction.

* * * * *